United States Patent [19]

Rue

[11] 4,218,851

[45] Aug. 26, 1980

[54] HIGH SPEED ROTATABLE ABRASIVE BODY AND MOUNTING

[75] Inventor: Charles V. Rue, Petersham, Mass.

[73] Assignee: Norton Company, Worcester, Mass.

[21] Appl. No.: 19,268

[22] Filed: Mar. 9, 1979

[51] Int. Cl.[3] ..... B24D 17/00

[52] U.S. Cl. ..... 51/168; 51/204; 51/206 NF

[58] Field of Search ..... 51/204, 206 R, 206 NF, 51/206.4, 206.5, 168, 169

[56] References Cited

U.S. PATENT DOCUMENTS

| | | | |
|---|---|---|---|
| 1,918,392 | 7/1933 | Hohnhorst . | |
| 2,092,591 | 9/1937 | Sohlstrom | 51/206 NF |
| 2,173,461 | 9/1939 | Wagner | 51/206 R |
| 2,173,462 | 9/1939 | Wagner | 51/206 R |
| 2,351,561 | 6/1944 | Thompson | 51/168 X |
| 2,693,670 | 11/1954 | Perry | 51/168 |
| 2,809,478 | 10/1957 | Lewis | 51/206 R |
| 2,958,165 | 11/1960 | Hofmann | 51/169 |
| 3,367,068 | 2/1968 | Dooley | 51/168 |
| 3,636,665 | 1/1972 | Shaw | 51/206.5 |
| 3,780,476 | 12/1973 | Sipe | 51/168 |

FOREIGN PATENT DOCUMENTS

| | | | |
|---|---|---|---|
| 67442 | 4/1892 | Fed. Rep. of Germany . | |
| 2530835 | 1/1977 | Fed. Rep. of Germany | 51/168 |
| 393269 | 12/1908 | France | 51/206 R |
| 451781 | 8/1936 | United Kingdom | 51/206 R |

OTHER PUBLICATIONS

Fifth Annual Report, Grinding Wheel Institute, Sweeney et al., Apr. 1969.

*Primary Examiner*—Gary L. Smith
*Attorney, Agent, or Firm*—Walter Fred

[57] ABSTRACT

A high speed rotatable elongated holeless reinforced resin bonded abrasive body (10) comprising a central mounting portion (12) including diametrically opposite arcuate segments (14) with arcuate inclined surfaces (16) angularly displaced normal to diametrically opposite grinding portions (18) extending radially therefrom to arcuate grinding surfaces (22) and reinforcing elements (26) bonded to and extending continuously through the central portion (12) and grinding portion (18).

Spindle mounting means (40) (70) are provided with inner drive flanges (44) (74) and outer clamping flange (60) for clamping and driving a single abrasive body (10) an outer flange (90) for clamping and driving a plurality of angularly spaced abrasive bodies (10*a* and 10*b*) and to which flanges (60) (90) additional similar clamping drive means may be fastened and angularly spaced from one other, to mount additional abrasive bodies (10) to the spindle mounting means (40) (70).

12 Claims, 7 Drawing Figures

HIGH SPEED ROTATABLE ABRASIVE BODY AND MOUNTING

TECHNICAL FIELD

The invention relates to high peripheral speed rotary abrading tools and particularly to a "holeless" reinforced resin bonded abrasive body of elongated shape and spindle mounting therefor adapted for high speed billet conditioning and foundry snagging grinders, where economical, safe and rapid stock removal without wheel breakage and resulting injuries to workman are highly desireable to the industry.

BACKGROUND ART

Presently, resinoid bonded abrasive snagging wheels are limited to operating safely at a peripheral surface speed of 5029.2 meters per minute (16500 sfpm). Higher speeds have been attained with segmental wheels such as disclosed in the "Fifth Annual Report of the Grinding Wheel Institute Investigation of Grinding Fundamentals" April 1969, pages 6-1-6-36 and by Milton Shaw in U.S. Pat. No. 3,636,665 but none have been proved to be economically feasible.

It is also well known that the bursting strength of a grinding wheel can be increased by decreasing mounting spindle or arbor hole size up to the maximum where the wheel is "holeless". "Nohole" wheels of various configurations are disclosed in U.S. Pat. Nos. 1,918,392; 2,173,461; 3,367,068 and 3,780,476; British Pat. No. 451,781 and German Pat. No. 67,442. Solid center or holeless wheels were and are still being used to limited extent but are expensive to make and difficult to mount for rotation about their axis. Some of the solid center wheels disclosed in the above mentioned patents have either projections or recesses on one or both sides thereof engaged by opposing drive flanges of the spindle mounting. In some cases the flanges or studs are permanently fixed with adhesive to the sides of the wheel while in others the wheel is clamped between a pair of flanges at least one of which is adapted to be removed and displaced axially relative to the other.

Also known are a number of methods and materials whereby a grinding wheel may be reinforced against bursting and holding fragments of a burst wheel together to prevent injury to the workman and the apparatus. For example, the prior art teaches reinforced wheels having dense non-grinding inner central zones of either bonded abrasive or "non-abrasive" particles of finer grit size than used in the outer grinding zone, or a greater amount of bond holding the particles together than in the outer zone.

In addition, various organic and inorganic reinforcing material in the form of chopped or short continuous fibers, rods, webs, rings, wire mesh, cloth, having either twisted or untwisted continuous filaments and discs of woven or non woven fibers, continuous filaments or roving have been bonded to or molded within wheels. However, the reinforcement generally extends radially outward from and around the center of the wheel but did not pass continuously through the center of the wheel to opposite surfaces thereof.

U.S. Pat. No. 2,809,478 discloses a relatively small high speed grinding wheel of similar elongated shape with opposing arcuate grinding surfaces but has a conventional arbor mounting hole therein.

DISCLOSURE OF THE INVENTION

The present invention comprises an integral high speed "holeless" solid reinforced rotatable resin bonded abrasive body with arcuate peripheral grinding surfaces and spindle mounting means therefor.

The abrasive body has generally an elongated rectangular shape similar to the remaining center part of a circular grinding wheel from which two identical diametrically opposite arcuate segments have been removed. The abrasive body has a central portion with diametrically opposite arcuate spindle flange mounting segments with tapered surfaces projecting from opposite edges of diametrically opposite grinding portions extending substantially at right angles therefrom to diametrically opposite peripheral grinding surfaces.

Suitable reinforcement material is bonded to the wheel and extends continuously through its center to opposite arcuate peripheral grinding surface thereof.

Means for mounting one or more of the abrasive bodies are provided comprising a spindle flange fixed to and driven by the machine spindle. The flange has a central recessed surface, diametrically opposed arcuate tapered shoulders and surfaces for mating engagement with the arcuate mounting segments of the abrasive body and diametrically opposite slots through and beyond which the diametrically opposite grinding portions of the abrasive body extend. A clamping flange fastened to the spindle flange maintains each abrasive body in compressive locating and driving engagement therewith.

Alternatively, a clamping flange and additional intermediate flanges with at least one central recessed surface, diametrically opposite arcuate tapered shoulders and slots and fastening means may be provided for locating and clamping one or more angularly spaced abrasive bodies to an adjacent abrasive body and the spindle flange. Thus, a high speed rotary abrading device with two or more pairs of angularly spaced arcuate peripheral grinding surfaces is provided.

BEST MODE FOR CARRYING OUT THE INVENTION

Figure 1:
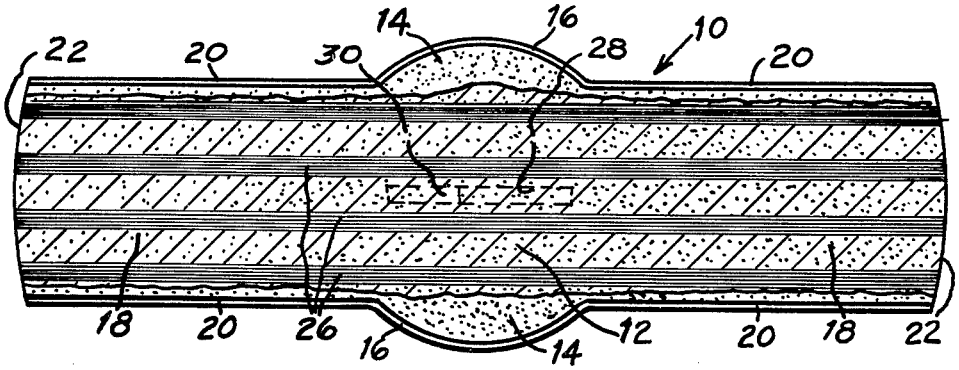
FIG. 1 is a side view partly in section of the rotatable abrasive body of the invention.
Figure 2:
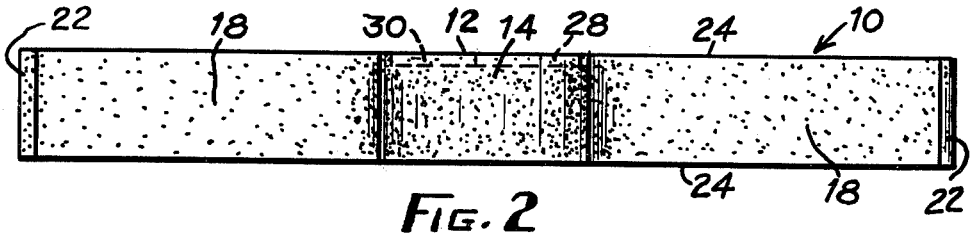
FIG. 2 is a front view of the abrasive body shown in FIG. 1.
Figure 3:
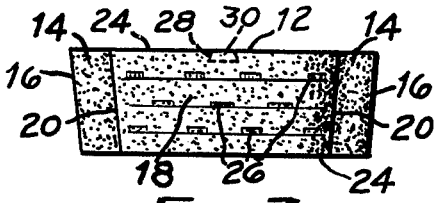
FIG. 3 is an end view of the abrasive body shown in FIGS. 1 and 2.

In the drawings is shown an integral solid and holeless high speed rotatable reinforced resin boned elongated abrasive body 10 of predetermined axial thickness, width and diameter. The body 10 has the general shape of a rectangular plate or bar with curved ends and very similar to the remaining part obtained by removing diametrically opposite arcuate segments from a wheel or circular plate. The abrasive body 10 comprises a solid or holeless central mounting portion 12 including a pair of diametrically opposite arcuate segments or projections 14 with arcuate tapered surfaces 16 of predetermined radius, diameter and inclination relative to its central axis of rotation.

Extending radially outwardly from diametrically opposite sides of the central mounting portion and perpendicular to a plane passing through the center of the diametrically opposite segments 14 are a pair of elongated grinding portions 18 including opposite parallel tapered edges 20 and arcuate peripheral grinding surfaces 22 of predetermined radius and diameter.

Situated within and axially spaced between opposite parallel sides 24 of the abrasive body are a number of layers of reinforcing material 26. Preferably, each layer comprises a thin backing or scrim of non woven glass fibers or paper to which a plurality of continuous ropes or roving of reinforcing material 26 are adhesively secured in spaced relationship. Preferably, the ropes or roving are comprised of substantially untwisted continuous fiberglass filaments extending continuously between and to the peripheral grinding faces. However, other types and forms of reinforcing materials such as high tensile steel wire, braided rovings of fiberglass and glass cloth well known to those skilled in the art may be used instead. Further, the reinforcement may be prestressed as practiced in making of prestressed concrete beams.

Alternatively, the straight opposite grinding portions 18 including the arcuate grinding surface may be gradually increased in width by smoothly flaring or curving the opposite edges 20 outwardly from the adjoining central portion to an arcuate grinding surface or greater length. Further, the grinding portion of gradually increasing width can be reinforced by providing therein smoothly curved continuous strands of reinforcement 26 on opposite sides of the straighter centermost strands of reinforcement 26.

Various well known means may be employed for balancing the high speed rotary abrasive body 10. One such means includes molding or cutting a narrow and shallow elongated slot 28 in the center of the central mounting portion on at least one side of the body. Preferably, the elongated slot has a length substantially equal to the diameter of the central portion 12 and extends longitudinally through the axis of the body substantially parallel to the opposite edges 20. The slot may have any cross sectional shape which will accept and retain a balancing weight 30 affixed thereto in any suitable manner.

For example, the slot 28 may be made to have either a, U, T, or dovetail shape into which a shorter balance weight 30 of relatively heavy metal such as lead and the corresponding cross sectional shape is slideably mounted and fixed in the balancing position relative thereto. The weight 30 may be adhesively or frictionally secured as by clamping, staking, upsetting, deforming or wedging it in the slot 28.

Except for the shape of the mold cavity, the abrasive body 10 of the invention may be manufactured in various sizes, of substantially any of the abrasive and bonding materials and by methods and apparatus well known in the art of manufacturing conventional grinding wheels.

For example a holeless reinforced bonded abrasive body 10 for rapidly snagging or conditioning billets at peripheral surface speed up to 25000 sfpm (7620 smpm) may have the following dimensions: a length or transverse dimension of 36" (91.44 cm) between the arcuate grinding faces 22, an axial thickness of 4" (10.16 cm), a grinding portion maximum width of 10" (25.4 cm) between the edges 20 and a central mounting portion 12 with a maximum radius of 6" (15.24 cm) and diameter of 12" (30.48 cm) at the larger end or side of the tapered surfaces 16 and 20 inclined at an angle of about 5°.

The abrasive body 10 is molded in a conventional hot press type mold assembly having a mold cavity therein corresponding to the desired size and shape.

An example for manufacturing a reinforced hot pressed abrasive body 10 comprises calculating the volume of the hot pressed abrasive body desired, preparing a mixture of suitable abrasive and bond in the ratio of 60 parts of abrasive and 40 parts bond by volume. The bond consisting of the following ingredients by weight %:

| | |
|---|---|
| Varcum 1930 phenolic resin | 38.5% |
| Iron pyrites | 28.9% |
| Potassium Fluoroborate | 14.6% |
| Saran | 5.4% |
| Lime | 12.6% |
| | 100% |

A mixture of abrasive and bond consisting of the following percentages by weight is prepared having a density of 3.044 1 g/cc.

| | |
|---|---|
| 12 grit size sintered bauxite abrasive | 72.9% |
| bond | 27.1% |
| | 100% |

The mix is prepared by wetting the abrasive in a mixing pan with a small amount of furfural (20 cc per pound of the powdered resin in the bond) then the bond is added and thoroughly mixed therewith.

The volume of the reinforcing material is calculated and deducted from the volume of abrasive bond mix. The remaining volume of the mix is then divided into portions of predetermined volume depending on the type, location, spacing and number of layers or reinforcement used. For example if three layers of identical reinforcement are to be embedded so they are equally spaced from one another and each of the opposite sides 24, the mix would be divided into four equal parts to form the four adjoining layers of equal thickness. However, the layers of reinforcement may not be distributed equally and hence the volume of each layer of mix will have to be calculated and added to the mold in the proper sequence.

Alternate layers of the mix and reinforcement of fiberglass rovings on scrim are placed in the mold cavity of a mold assembly comprising a mold band, top and bottom plates. The mold assembly is then placed between heatable plates of a conventional hot press; pressed to 281.2 kg/cm$^2$ (2 tons per square inch) and heated to 160° C. After 45 minutes the molded abrasive body is stripped from the mold, placed and cured in an oven for b 24 hours at 175° C.

Alternatively, the abrasive body may be provided with an integral fine strong center simultaneously molded of resin bonded finer grit size abrasive or non abrasive materials well known in the art. Hence, the central portion of the mold cavity is separated from the rest of the mold by a thin band of the desired diameter during the filling of each layer in the mold.

The different mixes are divided and layered in the mold between the reinforcement as taught above. The thin band is removed after each layer of the different mixtures and before each layer of reinforcement is placed into the mold. After the required number of layers of mix and reinforcement, the mold is closed and the mixtures are pressed and cured into an integral solid resin bonded abrasive body.

Figure 6:
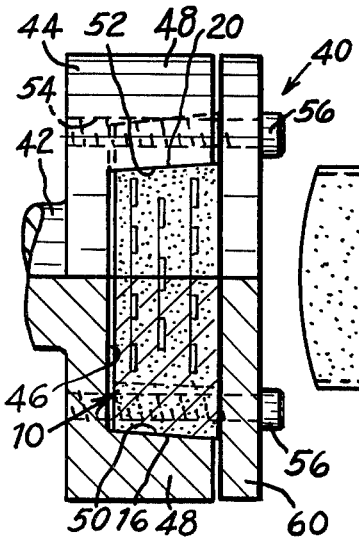
FIG. 6 is a front view partly in section of a spindle mounting assembly locating and supporting a single abrasive body for rotation about a central axis.
Figure 7:
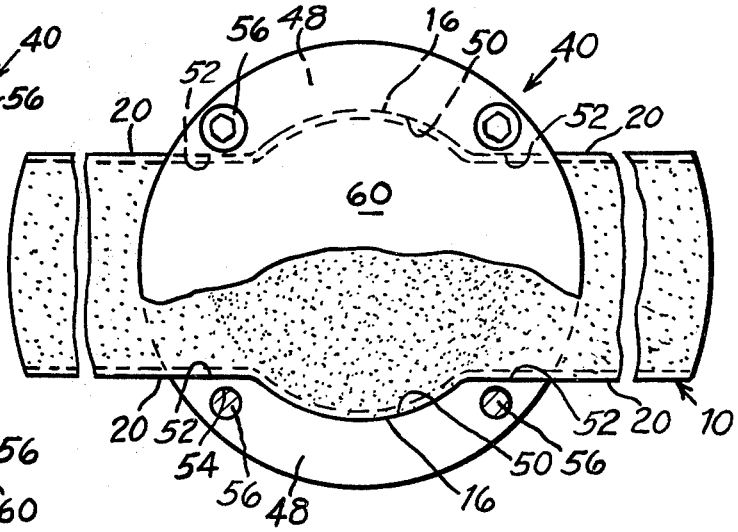
FIG. 7 is a side view of the apparatus shown in FIG. 6 with portions thereof broken away.

Spindle mounting means 40 are provided as shown in FIGS. 6 and 7 for mounting and compressively supporting a single abrasive body 10 in a suitable grinding apparatus for high speed rotation about an axis.

The spindle mounting means assembly 40 comprises a rotatable drive spindle 42, only a portion of which has been shown that may be rotatably journalled in a suitable high speed grinding apparatus or conventionally fixedly coupled to the rotatable drive spindle thereof.

An inner drive flange 44 has a central recess including diametrically opposite slots and recessed surface 46 extending between diametrically opposed arcuate segments 48 to tapered arcuate surfaces 50 and tapered end surface thereon 52 adapted for mating, clamping and driving engagement with the arcuate portions 14 and tapered surfaces 16 and 20 of the abrasive body 10. Preferably the dimensions of the recessed surface 46 and small end of recess between tapered surfaces 50 nd 52 are slightly less than the adjacent surface 24 and the small end of side of the tapered central portion 12 of the body 10. Thus, a slight clearance between body 10, surface 46 is provided to prevent bottoming and to properly clamp the abrasive body 10.

If desired, a blotter or gasket of suitable size, shape and resilent material, such as that used for wheel blotters, may be placed on each of the opposite surfaces 24 of the abrasive body to cushion the clamping pressure applied thereto. A plurality of angularly spaced threaded holes 54 and bolts 56 are provided in the arcuate segments 48 for attaching an outer clamping flange 60. The outer clamping flange 60 has clearance holes for receiving the bolts 56 and an inner surface for engaging and clamping the abrasive body 10 to the inner drive flange 44.

Figure 4:
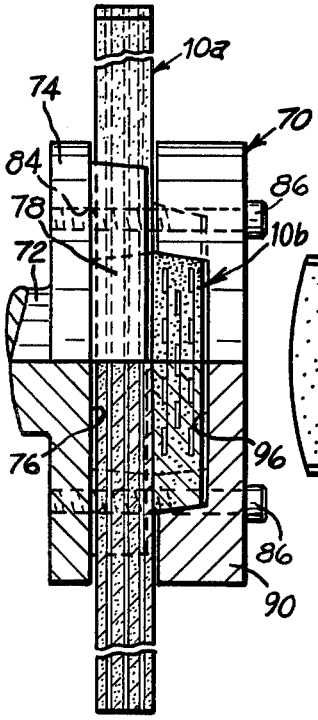
FIG. 4 is a front view, partly in section of a spindle mounting assembly locating, and supporting a pair of the abrasive bodies for rotation about a central axis.
Figure 5:
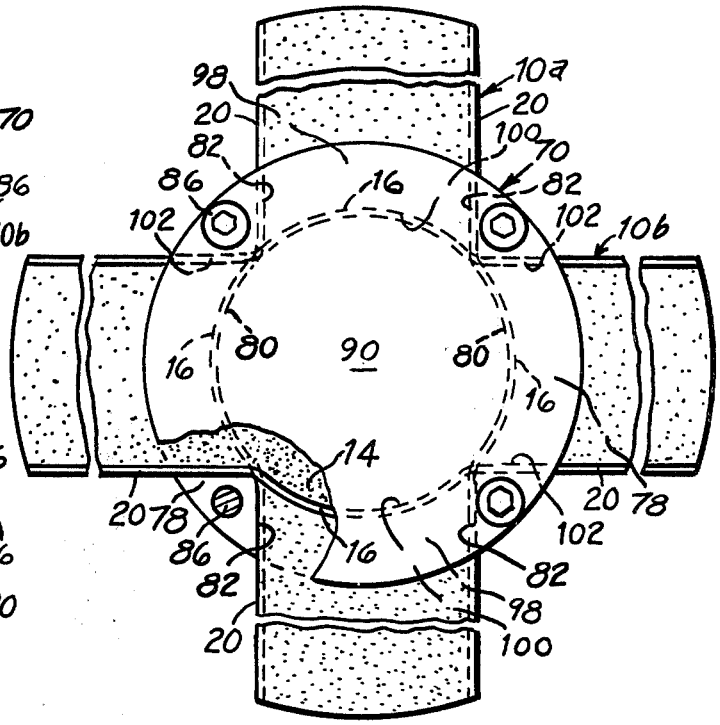
FIG. 5 is a side view of the apparatus shown in FIG. 4 with portions thereof broken away.

In FIGS. 4 and 5, there is shown spindle mounting means 70 for mounting and supporting a pair of abrasive bodies 10*a* and 10*b* at right angles to each other for rotation by a suitable grinding apparatus. The inner and outer abrasive bodies 10*a* and 10*b* and portions of the mounting means 70 in this instance, are shown to be less than and about half the axial thickness of those shown in FIGS. 6 and 7. However, they may be of the same axial thickness as those described hereinabove and shown in FIGS. 6 and 7 and comparable in size and thickness to which conventional snagging wheels are made.

The spindle mounting means assembly 70 comprises a rotatable drive spindle 72 which may be rotatably journalled in a suitable high speed grinding apparatus, or adapted to be coupled in any conventional manner to the rotatable driven spindle of the apparatus.

Integral with or attached to the end portion of the spindle 72 is an inner flange 74 having a central recessed surface 76 extending between diametrically opposed arcuate segments 78 and tapered surface 80 and 82 adapted for mating, clamping and driving engagement with the arcuate portions 14 and tapered surfaces 16 and 20 of the inner abrasive body 10*a*. Angularly spaced threaded holes 84 and bolts 86 are provided in the arcuate segments 78 for clamping the inner and outer abrasive bodies and outer clamping flange 90 to the inner flange 74.

The outer clamping flange 90 has clearance holes for receiving the bolts 86 and a recessed surface 96 extending between diametrically opposed arcuate portions or segment 98 and tapered surface 100 and 102 adapted for mating compressive clamping and driving engagement with the arcuate portions 14 and tapered surfaces 16 and 20 of the outer abrasive body 10*b*.

The dimension of recess surface 76 between the tapered surface 80 and 82 and recessed surface 96 between tapered surface 100 and 102 at the small end of the tapered recess are slightly less than that of the adjacent side surface 24 between tapered surfaces 16 and 20 at the small side of the tapered central portion 12 of the abrasive bodies. Thus, clearances are provided therebetween to prevent bottoming and to properly clamp the abrasive bodies 10.

As shown, the tightening of the bolt 86 causes the outer clamping flange to align and clamp the outer abrasive body 10*b* against and substantially 90° from the inner abrasive body 10*a* simultaneously aligned and clamped by the engaging inner clamping flange 74.

If desired a thin blotter of gasket or layer of resilent cushioning material such as used for wheel blotters may be inserted between the inner and outer abrasive bodies and between the mating tapered surfaces of the flanges and abrasive bodies to prevent abrasive contact therebetween, breakage, compensate for surface irregulaties and cushion the compressive clamping pressure.

Although not shown, additional angularly spaced abrasive bodies and intermediate flanges may be attached to the spindle mounting assemblies. For example, another recessed flange similar to flanges 44, 74, or 70 could be made an integral part of or attached to the existing flange 70 to position another or third abrasive body angularly between the axisting abrasive bodies 10*a* and 10*b*. Obviously, this can be done by providing either the single recess flange or double recess flange with threaded holes and bolts located between the existing bolts 86 for attaching either another or fourth abrasive body and clamping flange 70 or a clamping flange 60 thereto.

It is well known in the art that the efficiency of a grinding wheel increases and it will remove more material in a given unit of time and per unit volume of the wheel with an increase in peripheral surface speed.

Also, known from past studies that intermittent contact between wheel and work increases depth of cut and hence the material removal rate, helps cool the wheel and work whereby the lower operating temperature lessens the danger of overheating the wheel and burning of the work.

Further known is that the bursting or rupture speed and strength of a grinding wheel can be increased by eliminating the arbor hole; making the center portion of finer or stronger materials and by the addition and arrangement of various types of reinforcing material.

In the "Fifth Annual Report—Grinding Wheel Institute Investigation of Grinding Fundamentals", April 1969, Carnegie Institute of Technology Pittsburg, Pa., Chapter VI entitled "Conditioning of Slabs and Billets" page 6-1 to 6-36 there is disclosed the results of grinding tests with high speed segmental snagging wheels.

A performance grinding test was conducted between a conventional 24"×3"×12" (610 mm×76 mm×305 mm) wheel and a segmental snagging wheel consisting of eight relatively smaller angularly spaced relatively smaller circular segments 4" (10.16 cm) diameter clamped to a 24" (60.96 cm) diameter aluminum disc, run at 12,500, 21,000, and 25,000 sfpm (3810, 6401 and 7620 smpm). It is evident from the results shown in Table 6-1 page 6-4 that the segmental wheels with a relatively small amount of peripheral grinding surface area contact with a 400 lb (181.4 kg) head load had four times the material removal rate (M) per unit of time but removed a smaller amount of material per unit volume of abrasive consumed (G ratio) than a conventional wheel run under the same conditions at 12500 sfpm (3810 smpm). However, the data also discloses that as the peripheral speed of the segmental wheel was increased to 21000 sfpm (6401 smpm), the M rate increased another 40% and the G ratio more than doubled and at 25000 sfpm (7620 smpm) the M ratio increased again about 20% and the G ratio increased about 25% more.

Thus, at 25,000 sfpm (7620 smpm) the segmental wheel had a M rate about 6.5 times greater and a G ratio closely approaching or about 80% that of the conventional wheel run at 12,500 sfpm (3810 smpm).

As a result of the tests it can be ascertained that the applicants solid reinforced abrasive body which intimittently contacts the work with relatively much larger angularly spaced grinding portions will under similar conditions have a material removal rate M substantially greater than and a G ratio approaching that of a conventional 24"×3"×12" (610 mm×76 mm×305 mm) snagging wheel presently operating at 16,500 sfpm and compatable with those attained by the segmental wheel tested.

To test the effect of reinforcing elements extending continuously and longitudinally through an abrasive body a number of resin bonded abrasive bars 4" (10.16 cm) long×1" (2.54 cm) wide×½" (1.27 cm) thick with and without continuous reinforcement were made and tested for modulus of rupture. Each bar was made from a resin bonded abrasive mix now used for making the fine strong centers in the state of the art wheels.

The bars reinforced with nine layers each consisting of 20 continuous lengths of high tensile steel wires 0.010 of an inch (0.254 mm) in diameter had a breakage strength of 25,367 psi (1783.6 kg/cm$^2$) and those without reinforcement a breakage strength of 15,120 psi (1063.1 kg/cm$^2$).

Thus, the reinforced bars were about 68% stronger than the non-reinforced bars which means they can be safely rotated at a relatively much higher surface speed than the 24,000 sfpm (73.15 smpm) at which it has been determined the non-reinforced bars can be safely rotated.

Presently a conventional reinforced resin bonded abrasive snagging wheel with an arbor hole equal to ½ its diameter has an average bursting speed of about 33,000 sfpm (10058 smpm) and minus the usual safey factor can be run safely at about 16,500 sfpm.

In comparison, a holeless reinforced resin bonded abrasive body made according to the invention is calculated to have, depending on the amount and type of reinforcement and whether or not it has a fine strong center, a bursting speed of from 40,000 to 47,000 sfpm (12192 to 14326 smpm) respectively.

The applicants holeless high speed abrasive body is preferably made to take advantage of significant advancements in the art to which it pertains. That is, its solid, elongated configuration allows it to be made in various sizes, have a fine hard dense and strong center or central mounting portion comparable to those of fine hard center wheels. It can be further strengthened by the addition of short fibers and various types of reinforcement that extend continuously through and tie the fine central and opposite grinding portions together. Also, its configuration allows it to run cooler, and intermittently contact the work and to remove material rapidly from the work.

Hence, the abrasive body of the invention is relatively much stronger and can be driven safely at relatively much higher surface speeds than heretofore possible with conventional resin bonded abrasive grinding wheels.

In operation each abrasive body mounted on and rotated by the mounting means has two arcuate grinding surfaces each of which may for example contact the work for about 30° or 1/12 of each revolution thereof.

Hence, each abrasive body intermittedly contacts the work once every 180°−30° or 150° of rotation, twice for a total of 60° or 1/6 of each 360° revolution which leaves 360°−60° or 300° of no work contact by the abrasive body and 360°−30° or 330° of no work contact by each abrading surface during each revolution.

As a result both the work, the abrasive body, and each of its pair of abrading portion has more time to cool off between the intermittent contacts.

Although rotation of mounting means assembly with two or more abrasive bodies together increase the number of angularly spaced abrading surfaces and frequency of contact with the work it does not change the above relationship between the work and each individual abrasive body in the assembly.

At high speed and controlled force the relatively large arcuate abrading portions of each abrasive body has very little time and are less likely to cut too deeply into the work and cause damage which it is known can occur when grinding with narrow abrasive segments spaced 180° apart and too much head force.

Obviously, the possibility of damage can be reduced in various ways as by increasing the width of the abrasive bodies, regulating head force and or feed rate to control depth of cut and increasing the number of angularly spaced abrasive bodies in the assembly.

As many modifications may be made of the invention, it is to be understood that embodiments disclosed hereinabove are for illustrative puposes only and that the invention includes all embodiments and modifications thereof falling within the scope fo the appended claims.

What is claimed is:

1. A high speed rotatable holeless resin bonded abrasive body comprising:

a central mounting portion including diametrically opposite arcuate segments and outer arcuate surfaces adapted for aligned compressive clamping, driving and supporting engagement by suitable spindle mounting means adapted for rotating the abrasive body about an axis; and diametrically opposite grinding portions of predetermined width extending radially outward from the central mounting portion to diametrically opposite arcuate peripheral grinding surfaces.

2. A high speed rotatable holeless resin bonded abrasive body according to claim 1 wherein the diametrically opposite arcuate segments each have a tapered arcuate clamping surface inclined relative to a central axis of the central mounting portion and extending arcuately between and above adjoining sides of the diametrically opposite grinding portions situated substantially perpendicular to a plane passing through the diametrically opposite arcuate segments.

3. A high speed rotatable holeless resin bonded abrasive body according to claim 1 wherein the central mounting portion further comprises:

resin bonded particles of smaller grit size than resin bonded abrasive particles in the diametrically opposite grinding portions whereby the abrasive body has more strength and resistance to bursting at high speed.

4. A high speed rotatable holeless resin bonded abrasive body according to claim 1 further comprising:

reinforcing material extending continuously between the diametrically opposite arcuate peripheral grinding surfaces and bonded to the diametrically opposite grinding and central mounting portion.

5. A high speed rotatable abrading assembly comprising:

at least one high speed rotatable holeless resin bonded abrasive body each having a central mounting portion including diametrically opposite arcuate segments and outer arcuate surfaces, diametrically opposite grinding portions of predetermined width extending radially outwardly from the central mounting portion to arcuate peripheral grinding surfaces; and spindle mounting means in compressive clamping, supporting and driving engagement with the central portion for aligning, supporting and attaching each abrasive body to grinding apparatus for rotation about an axis.

6. A high speed rotatable abrading assembly according to claim 5 wherein the diametrically opposite arcuate segments of the abrasive body each have a tapered arcuate clamping surface inclined relative to a central axis of the central mounting portion and extending arcuately between and above adjoining sides of the diametrically opposite grinding portions situated substantially perpendicular to a plane passing through the diametrically opposite arcuate segments.

7. A high speed rotatable abrading assembly according to claim 5 wherein the central mounting portion further comprises:

resin bonded particles of smaller grit size than resin bonded abrasive particles in the diametrically opposite grinding portions whereby the abrasive body has more strength and resistance to bursting at high speed.

8. A high speed rotatable abrading assembly according to claim 5 wherein the resin bonded abrasive body further comprises:

reinforcing material extending continuously between the diametrically opposite arcuate grinding surfaces and bonded to the diametrically opposite grinding and central mounting portions.

9. A high speed rotatable abrading assembly according to claim 5 further comprising:

a plurality of the abrasive bodies situated axially adjacent one another and angularly spaced relative to each other on the spindle mounting means; and a plurality of clamping drive means on the spindle mounting means fastened to one another for compressively clamping, supporting and simultaneously rotating the plurality of abrasive bodies.

10. A high speed rotatable abrading assembly according to claim 5 wherein the spindle mounting means comprises:

an inner drive flange adapted to be coupled to and rotatably driven by a rotatable drive spindle of a suitable grinding apparatus and having diametrically opposite arcuate portions including opposite end surface and inner arcuate surfaces extending between the opposite end surfaces for mating, clamping and driving engagement with the diametrically opposite arcuate segments and outer surfaces of the central mounting portion of the abrasive body, a recess extending inwardly from an outer side of the drive flange to a recessed surface extending between the inner arcuate and end surfaces for receiving the central mounting portion of the abrasive body, and diametrically opposite slots situated between the opposite end surfaces of the diametrically opposite arcuate portions into and through which inner portions of the diametrically opposite grinding portions adjoining the central mounting portion extend;

an outer clamping flange adjacent an outer side of the central mounting portion of the abrasive body; and fastening means for attaching the outer clamping flange to the inner drive flange and compressively clamping the central mounting portion of the abrasive body within the recess into positive alignment and positive driving engagement with the inner drive flange.

11. A high speed rotatable abrading assembly according to claim 10 further comprising:

a second substantially identical abrasive body situated axially adjacent to and angularly spaced from the first mentioned abrasive body; and second clamping drive means on one side of the outer clamping flange for receiving and compressively clamping the second abrasive body for rotation with the first abrasive body and including second diametrically opposite arcuate portions angularly spaced from the first mentioned diametrically opposite arcuate portions in the drive flange including second opposite end surfaces and second inner arcuate surfaces extending between the second opposite end surfaces for mating clamping and driving engagement with the diametrically opposite arcuate segments and surfaces of the central mounting portion of the second abrasive body, a second recess extending inwardly from one side of the second driving and clamping means to a second recessed surface extending between the second inner arcuate and second end surfaces for receiving the central mounting portion of the second abrasive body; and second diametrically opposite slots situated between the second opposite end surfaces of the second diametrically opposite arcuate portions into and through which inner portions of the diametrically opposite grinding portions adjoining the central portion of the second abrasive body extend.

12. A high speed rotatable abrading assembly according to claim 11 wherein the outer arcuate surfaces of diametrically opposite arcuate segments of the central portion of the abrasive body and the inner arcuate surfaces of the diametrically opposite arcuate portions of the drive flange and of the second clamping drive means are mating tapered surfaces inclined relative to a central axis of the spindle mounting means.

* * * * *